United States Patent [19]

Travis

[11] Patent Number: 5,022,648

[45] Date of Patent: Jun. 11, 1991

[54] AEROBIC WAND

[76] Inventor: Steed Travis, Rte. 6, Box 73D, Maryville, Tenn. 37801

[21] Appl. No.: 547,920

[22] Filed: Jul. 3, 1990

[51] Int. Cl.[5] ..... A63B 21/02

[52] U.S. Cl. ..... 272/137; 272/93; 272/68; 272/131; 272/67

[58] Field of Search ..... 272/93, 137, 67, 68, 272/66, 84 R, 143, 135, 137, 140, 72 R, 141; 273/84

[56] References Cited

U.S. PATENT DOCUMENTS

| | | | |
|---|---|---|---|
| 1,714,391 | 5/1929 | McWhirter | 272/93 |
| 1,726,554 | 7/1927 | Gagnon | 273/84 R |
| 4,023,796 | 5/1977 | Kusmer | 272/137 |
| 4,249,724 | 2/1981 | Gabrielidis | 272/137 |
| 4,465,276 | 8/1984 | Cox | 272/137 |

*Primary Examiner*—Richard J. Apley
*Assistant Examiner*—Jerome W. Donnelly
*Attorney, Agent, or Firm*—Luedeka, Hodges, Neely & Graham

[57] ABSTRACT

The present invention is directed to an aerobic exercise device for exercising, conditioning, and toning body muscles. The aerobic device is formed of elongated tube sections joined together by a cylindrical, centrally located tension spring mechanism. A movable rod is contained within the tube sections and selectively displaced past a detent mechanism into or out of the cylindrical spring mechanism so as to respectively render the spring mechanism inoperable or operable. With the spring mechanism inoperable, the elongated tube sections and the spring mechanism form a rigid bar for exercising. On the other hand, when the spring mechanism is operable the tube sections can be forcibly pivoted about a central pivot point provided by the spring mechanism for muscle exercising. The preferred device is of sufficient length as permits the selective extension of the user's arms to their fully extended positions laterally from the body.

24 Claims, 4 Drawing Sheets

AEROBIC WAND

FIELD OF INVENTION

The present invention relates generally to aerobic exercise device, and more particularly to an elongated bar or wand containing a centrally located and selectively actuatable spring mechanism to provide a multiple-use wand for exercising, conditioning, and toning of body muscles.

BACKGROUND OF INVENTION

Aerobic exercises have long been used to loosen body muscles for increasing the flexibility of the muscles as well as for conditioning and toning of the muscles. Included in the facets of aerobic exercise is the use of a rigid, elongated rod which is held in the hands and then the hands and/or the body appropriately moved through various gyrations to loosen and increase the flexibility of the body muscles particularly those in the upper body region as in the back, neck and shoulder areas. For example, the flexing of the deltoid muscles, the latissimus dorsi, and the spinal rotators, can be achieved by holding the rigid rod behind the body at waist level with the hands appropriately spaced apart and the body sequentially twisted in both directions. The deltoid muscles and neck muscles, including the trapezius, are stretched when the rod is held with straight arms in front of the body and then slowly lifted overhead as far as possible. Also, by holding the rod vertically behind the back with one hand above the other and then moving the upper hand sideways will stretch the front shoulder muscles and increase body rotation. The shoulders, upper arms, and chest muscles can be stretched and conditioned by holding the rod overhead with straight arms and then bending the shoulders alternately to the right and to the left without moving the body at the waist. The holding of the rod behind the neck at shoulder height with the hands spaced apart and then twisting the body while doing side bends can be used to loosen muscles in the chest and trunk. Also, holding the rod behind the body at waist height with the rod held inside bent elbows and then twisting the body to the right and left increases flexibility of the spine.

The latissimus dorsi, the obliques, and the inner thigh muscles can be stretched and loosened using a rigid rod by extending one leg to the side and resting it on a elevated platform at chair height and then grasping the rod with extended arms above the head and bending sideways towards the extended leg. This bending exercises the spinal column as well as flexing the inner thigh muscles in the leg maintained on the floor.

By utilizing a rigid rod in aerobic exercises, such as described above, sufficient loosening and flexing of the various body muscles is achieved to significantly minimize injury to the muscles such as caused by strains and tears particularly during participation in sporting events and other muscle-straining exercises.

In addition to using the elongated rigid rod for conditioning and loosening the muscles, significant muscle conditioning and toning especially in the area of the deltoids, triceps and biceps, has been achieved by using various stretchable devices such as a device having longitudinally spaced-apart handles interconnected by an elastic strap or one or more tension springs. Appropriately positioning the arms and the stretchable device and then moving the hands away from one another against the resistance provided by the elastic strap or springs increases muscle tone as well as causing muscle buildup.

SUMMARY OF THE INVENTION

It is an objective of the present invention to provide a selectively flexible multiple-use aerobic exercise wand for flexing, conditioning, and toning body muscles in manners previously requiring the use of separate rigid rods and stretchable devices such as briefly described above. Generally, the aerobic wand or device of the present invention comprises a pair of elongated tubular means oriented in a longitudinally spaced apart end-to-end relationship. Spring means or tension producing means are disposed between and affixed to adjacently disposed end portions of each of the elongated tubular means for providing a biased flexural pivot point for each of the tubular means disposed on opposite sides of the spring means. Selectively movable means are supported by the elongated tubular means for contacting the spring means to immobilize the spring means for inhibiting the pivoting of the tubular means about the flexural pivot point. Alternatively, the selectively movable means can be moved out of contact with the spring means to mobilize or activate the spring means so that the tubular means can be pivoted about the flexural pivot point. Detent means are carried by one of the tubular means for engaging the selectively movable means to maintain the latter in or out of contact with the spring means.

With the selectively movable means in a contacting relationship with the spring means as provided by the movable means spanning the spring means, and contacting end portions of both tubular means the aerobic device is placed in a rigid mode so that the exercising of the muscles can be achieved in manners substantially similar to those described above for the rigid rod. Alternatively, the removing of the movable means from contact with the spring means or tension providing means places the aerobic device in a flexible mode so that the ends of each tubular section can be pivoted about a central axis provided by the spring means or with the latter providing sufficient tension or bias against such a pivoting movement so as to work the muscles to effect muscle loosening, conditioning, and toning. Thus, by selectively positioning the movable means within the tubular means, the spring means is immobilized or rendered inoperable so that the wand becomes rigid over the entire length thereof or, alternatively, the displacement of the movable means away from engagement with the spring means causes the spring means to become mobilized with the wand becoming flexible at the spring means. The wand in the flexible mode can be used alone for muscle exercising or in combination with the exercises normally achieved with the rigid wand. In addition to the exercising, toning, and flexing of the upper body muscles, the leg muscles can also be conditioned by using the wand in the flexible mode by placing the ends of the wand on suitable supports, positioning one leg over the wand immobilizing the foot, and then bearing down upon the spring means with the leg to flex the leg muscles.

Because of the extreme length or moments provided by the length of the aerobic wand the individual can vary the resistence by moving the hands towards or away from the central spring-containing section. The length of the aerobic wand preferably accomodates a man or woman of average height, i.e. average arm length, with their arms at full extension laterally from their body.

Another object of the present invention is to provide the aerobic wand with a simple spring-loaded detent arrangement so that the selectively movable means supported by the elongated means and utilized to mobilize or immobilize the spring means can be readily displaced within the tubular means to render the wand in the rigid mode or in the flexible mode with the spring-loaded detent holding the movable means in the selected position during normal exercising positions and movements.

Further objects of the present invention will become obvious upon an understanding of the following description or be indicated in the appended claims, and various advantages not referred to herein will occur to one skilled in the art upon employment of the invention in practice.

Figure 1:
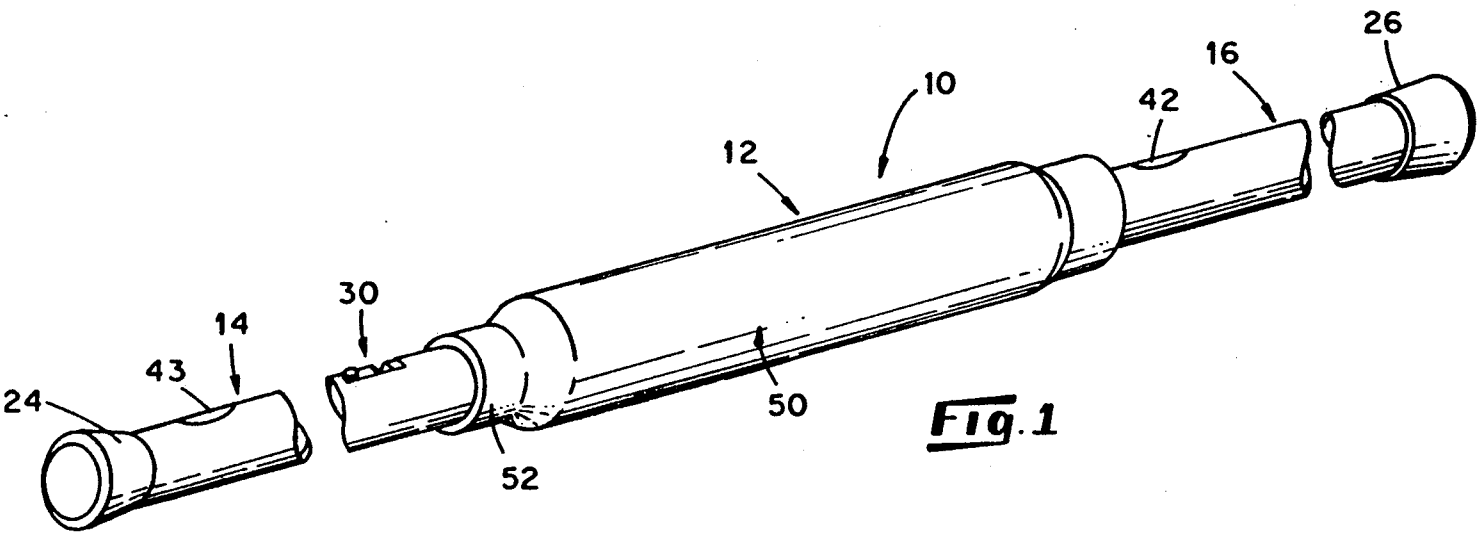
FIG. 1 shows a preferred form of the aerobic device of the present invention in a segmented longitudinal perspective view illustrating the selectively flexible spring-containing central section connected at each end to an elongated tubular arm section or segment.

Preferred embodiments of the invention have been chosen for the purpose of illustration and description. The preferred embodiments are not intended to be exhaustive nor to limit the invention to the precise forms disclosed. They are chosen and described in order to best explain the principles of the invention and their application and practical use to thereby enable others skilled in the art to best utilize the invention in various embodiments and modifications that are best adapted to the particular use contemplated.

DETAILED DESCRIPTION OF THE INVENTION

The aerobic wand of the present invention, as generally indicated by numeral 10, is utilized for the exercising, conditioning, and toning of body muscles such as in aerobic exercises as briefly described above. The aerobic wand of the present invention selectively provides for aerobic exercises normally attainable with a rigid exercise rod as generally referred to above as well as aerobic exercises in which muscle toning and/or build-up is achieved by bending or pivoting of opposite ends of the tubular aerobic wand about a central point containing a tension spring. The bending of the rod about the pivot point provided by the spring and the muscle stretching and conditioning exercises normally accomplished with the rigid wand may be accomplished sequentially or simultaneously to provide a muscle toning and building exercising program not heretofore attainable with any single previously known exercising device.

With particular reference to FIGS. 1–4, a preferred embodiment of the aerobic wand 10 of the present invention is shown formed primarily of three main sections or segments. An elongated, central springcontaining section 12 is coupled at each end thereof to an end of each of a pair of elongated tubular or open cylinder sections as generally shown at 14 and 16. The tubular sections 14 and 16 and the central spring containing section 12 are longitudinally oriented with adjacent ends or end portions of each tubular section joined to the spring to provide an elongated aerobic wand with an overall length in a range from about 36 to 72 inches. The minimum length of about 36 inches selected for the aerobic wand assures that individuals of average arm extension can readily utilize the present invention in various exercise programs requiring the positioning of the hands along the tubular sections at a location closer to or further away from the spring-containing central section 12. On the other hand, with the preferred longer length wands, i.e. up to about 72" in length, substantially all persons can utilize the wand with such person's arms fully extended laterally from the body and with their hands grasping the wand at widely separated positions, i.e. one hand grasping the wand on one side of the body and the other hand grasping the wand on the opposite side of the body. In this position of use, the central portion of the wand is in contact with the user's neck, torso, limbs, etc. and the fully extended arms are used to develop the desired torque on the wand, hence effect the desired exercise routines. The diameter of the tube forming each tubular section 14 or 16 is preferably in the range of about 1 to 1.5 inches. The centrally disposed spring section with appropriate padding thereon to facilitate its use is preferably of a diameter in the range of about 1.5 to 2.5 inches.

The central spring-containing section 12 is preferably provided by a tension spring 18 comprising a plurality of spring coils placed side-by-side with the coils being of a uniform outer diameter and having an inner diameter slightly greater than the outer diameter of the tube sections 14 and 16. The tube sections 14 and 16 are formed of metal or rigid plastic and can be readily joined to the coil at each end of the tension spring 18 by abutting the end of the tube sections 14 and 16 against the spring 18 or, preferably, by inserting end portions of the tube sections 14 and 16 slightly into the spring 18 and then providing a weldment or bond 20 at an appropriate contact point between the spring 18 and the tube sections 14 and 16 such as generally shown at 20 in FIG. 4. A spring tension device suitable for use in the present invention is an oil-tempered, extension steel spring commercially available as spring model A229 from Tricor Industries, Inc., King of Prussia, Pa. This commercially available tension spring has an inner diameter of 1.09 inches and an overall length of about 10.5 inches has been found to provide a suitable spring arrangement for use with tube sections having an outer diameter of 1.0 inch. Of course, other complementary spring and tube diameters may be satisfactorily used in the practice of the present invention.

With the tube sections 14 and 16 attached to the coil spring 18 the hollow interior of the tube sections 14 and 16 and the spring 18 form an elongated passageway 22 through the entire length of the aerobic wand 10. The open ends at either end of the wand 10 are provided with a suitable covering or plug such as generally shown at 24 and 26. These plugs may be formed from any rubber or plastomeric material which will provide a cushion at the ends of the wand so as to permit the rod to be placed upon the floor or bumped against various surfaces without damage to the floor or other surfaces or the wand itself. A suitable end covering 24 and 26 may be similar to the rubber tip provided on the foot of a crutch.

Figure 2:
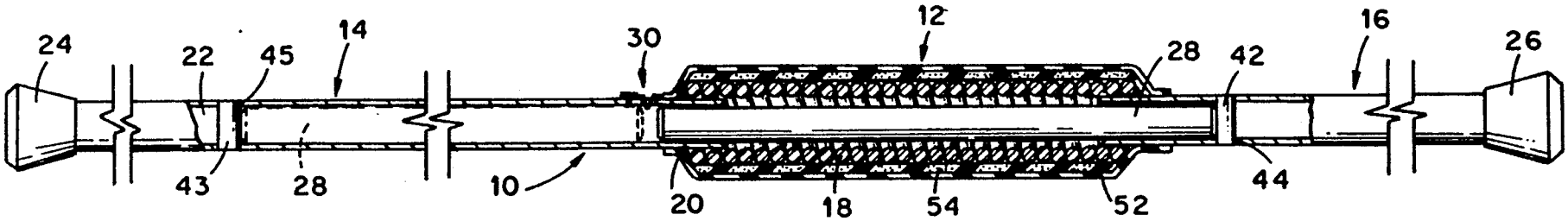
FIG. 2 is another view of the FIG. 1 embodiment with portions thereof shown in section for illustrating the coiled tension spring providing the central flexible section, the selectively displaceable or movable rod carried in the tubular arm sections of the wand and movable into or out of engagement with the spring in the central section for respectively rendering the wand in a rigid mode or a flexible mode, and the spring-loaded detent for permitting the selective movement of the rod and then maintaining the rod in the moved position.
Figure 3:
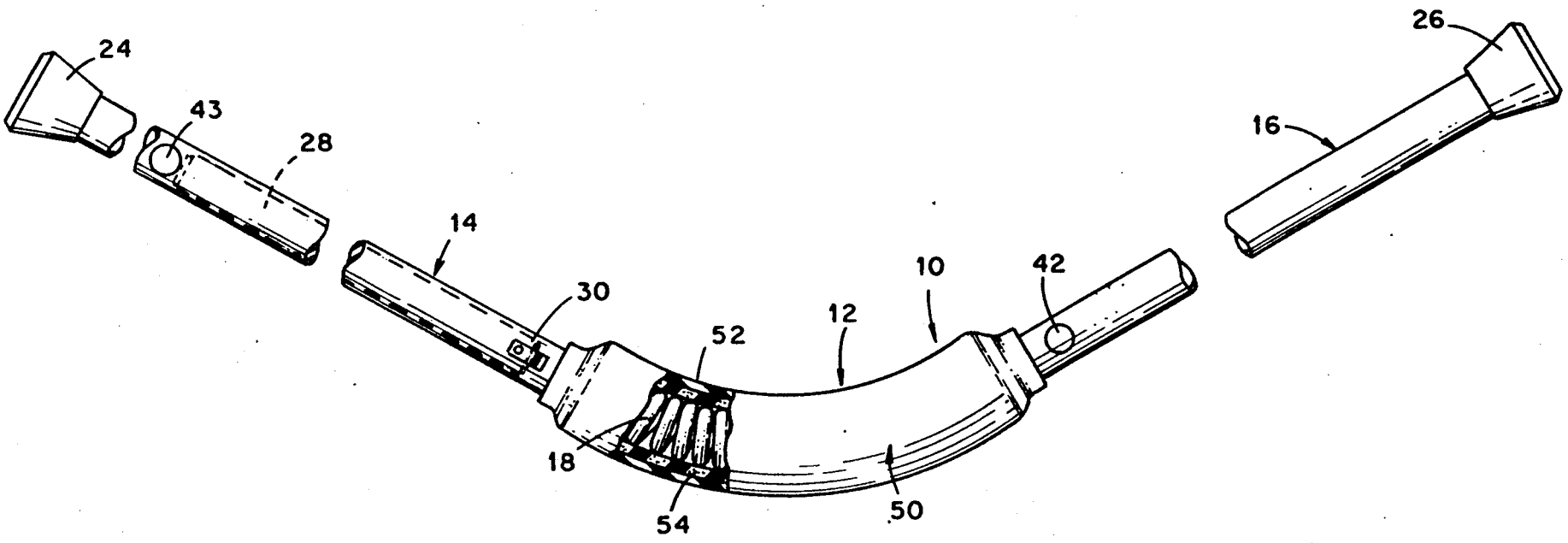
FIG. 3 shows the FIG. 1 embodiment of the present invention in the flexible mode wherein the movable rod in the tubular arm sections is moved away from the spring containing central section so that the wand can be bent or flexed about the central section.

As best shown in FIG. 2, an elongated movable rod 28 which is of a diameter slightly less than that of the inner diameter of the tube sections 14 and 16 and the spring 12 is contained within the passageway 22 and is displaceable within this passageway 22 so as to be selectively positioned in the central section 12 within the spring. The rod 28 is of a length sufficiently great so that end segments of the rod 28 extend beyond each end of the spring 18 into adjacent end portions of the tube sections 14 and 16 near the attachment thereof with the spring 18. Preferably, about 1 to 1.5 inches of the rod 28 extends from the spring 18 into each tube section 14 and 16 to maintain the spring 18 in an immobilized state or condition when the rod 28 is selectively positioned within the spring-containing central section 12. The movable rod 28 is in the form of a solid dowel or tube and can be formed of a suitable wood, plastic, or a light metal such as aluminum.

The rod 28 is displaced within the passageway away from the central spring section 12 into either tube section 14 or 16 a sufficient distance so that the rod 22 no longer spans or projects into the spring 18 and the spring 18 becomes mobilized or actuatable so that the ends 14 and 16 of the tubes can be pivoted or displaced about a central pivot point or axis provided by the spring 18. As mentioned above, the pivoting of the tube sections 14 and 16 about the central section 12 is achieved through a bias or tension loading provided by spring 18 so that considerable working of the body muscles can be achieved during the bending of the wand about the central pivot point.

In order to contain the rod 28 within an appropriate location within the passageway 22 in either the spring immobilizing mode or the spring mobilizing mode where the wand is respectively rendered rigid or flexible, a suitable detent means as generally shown at 30 is provided on tube section 14 for releasing the rod 28 to permit movement thereof within the passageway 22 and to maintain the rod 22 in the appropriate displaced position within the central section 12 or in the tube section 14 or 16.

Figure 4:
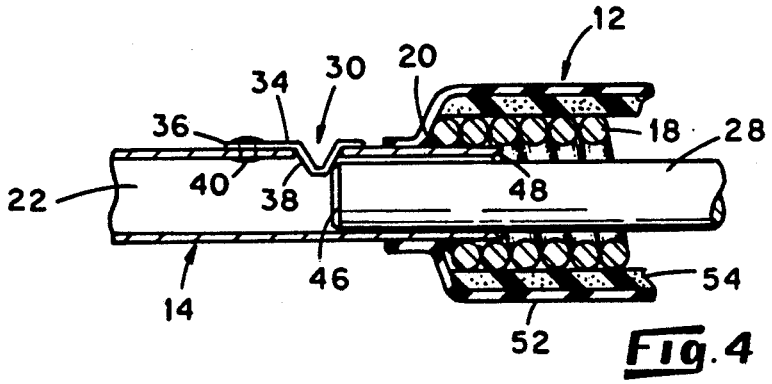
FIG. 4 is an enlarged fragmented sectional view of FIG. 2 showing details of the coupling of the spring to the tubular section, and the detent means for selectively maintaining the movable rod within the spring section or the tubular sections, and the padding employed about the spring for facilitating or easing body contact with the spring.

As best shown in FIG. 4, a detent means 30 suitable for use in the present invention may be provided by a leaf-like spring 34 having an elongated section 36 and a generally U-shaped end segment 38 which extends through a hole 39 in the tube section 14 and into the passageway 22 a sufficient distance to intercept and contact either end of the rod 28. The hole 39 is spaced from the spring 18 a distance substantially corresponding to the length of the rod 28 extending from the spring 18 when the latter is immobilized by the rod 28. The U-shaped end spring segment 38 of the spring 34 may be readily maintained in position within the passageway 22 by joining the elongated section 36 of the spring 34 at the end thereof remote to the U-shaped end segment 38 to the outer surface of the tube section 14 by employing a suitable rivet or other appropriate fastener such as generally shown at 40. The spring 34 is of a sufficient strength or bias to retain the rod 28 in either the center spring-containing section 12 or in the tube section 14 removed from the spring 18 during normal exercises. The bias provided of this spring 34 may be readily overcome by a slight tapping of the wand 10 against the floor or other surface so that the rod 28 moves the generally U-shaped section 38 of the spring 34 outwardly a sufficient distance to allow the rod 28 to pass by the spring 34 to achieve the displacement and position desired for the rod 28. For example, with the rod 28 within the central section 12 as generally shown in FIG. 2, the tapping of the end section 14 against the floor will permit the rod 28 to move from within the spring 18 into the tube section 14 as indicated in phantom in FIG. 2.

To assure that the movable rod 28 is displaced into an appropriate location within the central section 12 underlying the spring 18 without excessive travel into either end section 14 or 16, a suitable stop is provided in the tubing section 16 such as generally shown at 42. Alternately, when the rod 28 is displaced from within the spring 18 into the tube section 14 a suitable stop 43 is provided in the tube section 14 near the end thereof remote to the spring 18 for preventing the rod 28 from excessive travel within the tube section 14 and from contacting the end plug 24 on the tube section 14. These stops 42 and 43 may be respectively provided by extending a suitable rivet or the like into the passageway 22 through holes 44 and 45. The hole 44 for the positioning of the stop 42 is at a location on tube section 16 corresponding to the spacing of hole 32 for the detent means 30 from the coupling of the spring 18 to the end of the tubing section 14. The hole 45 for the stop 43, on the other hand, is at a location in the tube section 14 spaced from the detent means a length slightly greater than the length of the rod 28 so that the rod 28 can be moved into position between the detent means 30 and the stop 43 to maintain the rod 28 in the end section 14.

While the use of detent means 30 as generally described above may be desirable because of its simple actuation, it may also be desirable to use another type of detent means such as a readily removable plug or screw that can be inserted or removed at will by a hand or a spring actuated mechanism. Also, while the detent means 30 are shown in tube section 14, it will appear clear that the detent means 30 can be located on tube section 16 with the stops 42 and 43 suitably placed in the end sections 14 and 16.

In order to assure that the rod 28 can be readily displaced within the passageway 22, the rod 28 is preferably provided with a taper 46 at each end thereof. Further, the end of each tube section 14 and 16 adjacent to the spring 18 may be provided with a suitable taper 48 so that the rod 28 may be easily received within the tube sections.

The coil spring 18 is preferably covered with a suitable protective sleeve of elastomeric material as generally shown at 50 so that when the spring 18 is placed against the body sufficient padding or cushioning is provided to facilitate the use of the wand 10 as well as the inhibiting of any pinching by the spring 18. A suitable padding arrangement may be provided by covering the spring 18 with a simple rubber sleeve 52 which conforms to the outer surface of the spring 18 and bears against the tube ends so as to remain in place or by employing a cylindrical sponge rubber body 54 within such a rubber sleeve 52. The sponge body 54 preferably has an inner diameter essentially similar to that of the outer diameter of the spring 18 so as to be readily slipped over the surface of spring 18 and is preferably of a length generally corresponding to the length of the spring 18. The rubber sleeve 52 is of sufficient elasticity so that it can be slipped over the sponge body 54 and bear against the ends of the spring 18 and tube section 14 and 16 to maintain the sponge body 54 in place.

Figure 5:
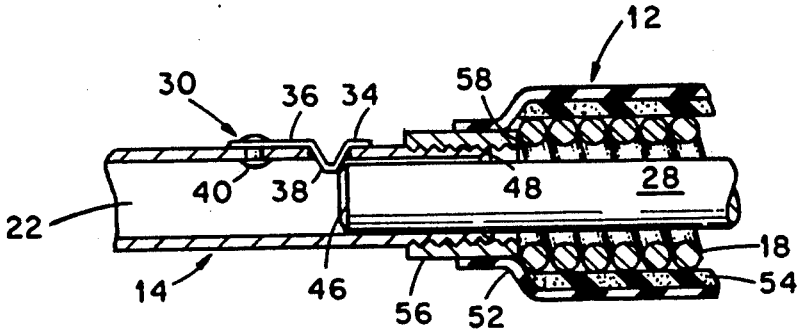
FIG. 5 is another embodiment of the present invention showing a threaded coupling between the tubular sections and the spring for facilitating assembly and disassembly of the aerobic wand.

As shown in FIG. 5, another embodiment of the present invention pertaining to the coupling arrangement between the other spring 18 and the tube section 14 and 16. In this embodiment an internally threaded sleeve 56 with an inner diameter substantially similar to that of the inner diameter of the spring 18 is joined to each end of the spring 18 by a weld 58. The internally threaded sleeve 56 is engaged by externally threaded ends 60 on tube section 14 and 16 so as to be selectively attached to the spring 18.

Figure 6:
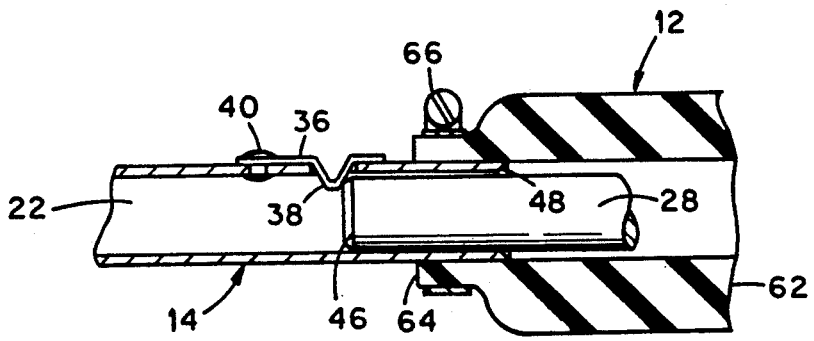
FIG. 6 is a further embodiment of the present invention in which the coil spring illustrated in FIGS. 1–5 is replaced by a thick sleeve of rubber or the like which is capable of providing the desired wand flexing and tension loading or resistance to the pivoting of the tubular sections.

Another embodiment of the present invention is shown in FIG. 6 wherein the coiled spring 18 of the embodiment of FIGS. 1–5 is replaced by a elongated cylinder of flexible material such as a elastomeric material or rubber as a generally shown as 62. This flexible cylinder 62 is of sufficient thickness and possesses sufficient tension so as to resist bending in a manner substantially similar to that provided by the coiled spring 18. This flexible cylinder 62 may be readily joined to the tube segments 14 and 16 by bonding or by providing the cylinder 62 with tapered ends 64 which are attached to the ends of tube sections 14 and 16 by a suitable clamp such as generally shown at 66.

Figure 7:
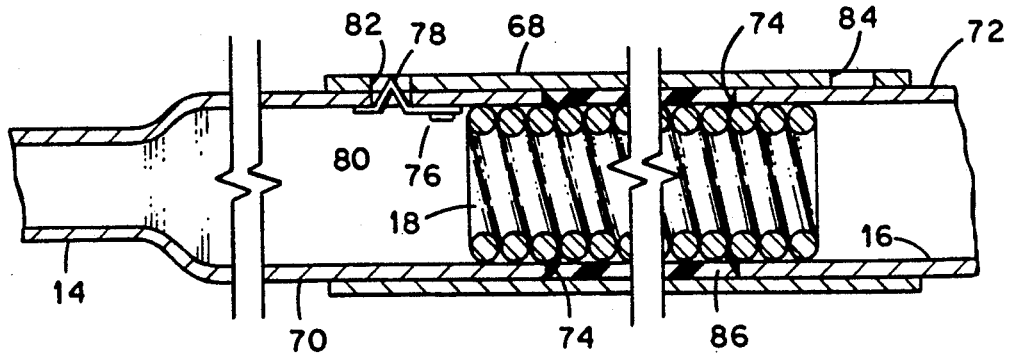
FIG. 7 is yet another embodiment of the present invention in which the movable rod in the tubular arm sections is replaced by a tube selectively slidable over the spring-containing central section and end portions of the tubular arm section adjacent to the spring for immobilizing the spring.

The embodiment shown in FIG. 7 differs from the embodiments shown in FIGS. 1–6 by replacing the movable rod 28 within the tube sections 14 and 16 with a movable tube 68 selectively positionable over the outer surface of the coiled spring 18 and end sections of the tubes 14 and 16 located adjacent to the spring 18. As shown in FIG. 7, the tubes 14 and 16 are provided with flared end segments 70 and 72 having inner diameters slightly greater than the outer diameter of the spring 18 so that a selected length of the end sections 70 and 72 may be positioned over opposite end segments of the spring 18 and welded in place as indicated by the weldment 74. The tube 68 which is formed of metal or plastic and which has an inner diameter slightly greater than outer diameter of the end sections 70 and 72, is selectively displaceable over the spring 18 and end portions of the end segments 70 and 72 to immobilize the spring 18 and render the wand 10 rigid or displaced along the flared end segment 70 away from the spring 18 to render the wand 10 flexible. The tube 68 can be made readily positionable on or off of the spring 18 by using a suitable detent arrangement such as generally shown at 76. This detent arrangement 76 is shown comprising a spring mechanism similar to that used for the detent means 30 in FIGS. 1–6 but differing therefrom by positioning the leaf-like spring so that the U-shaped end section 78 of the detent spring projects outwardly through a hole or bore 80 in the flared end segment 70. The movable tube 68 is provided with openings 82 and 84 near the longitudinal ends thereof for receiving the U-shaped end section 78 of the detent arrangement 76 in opening 82 when the tube is positioned over the spring 18 as shown and in opening 84 when the tube is moved away from the spring 18. As shown in FIG. 7, a sleeve 86 of rubber or sponge may be placed about the spring 18 between the ends of the tubes 14 and 16 for providing a padded surface over the spring 18.

Figure 8:
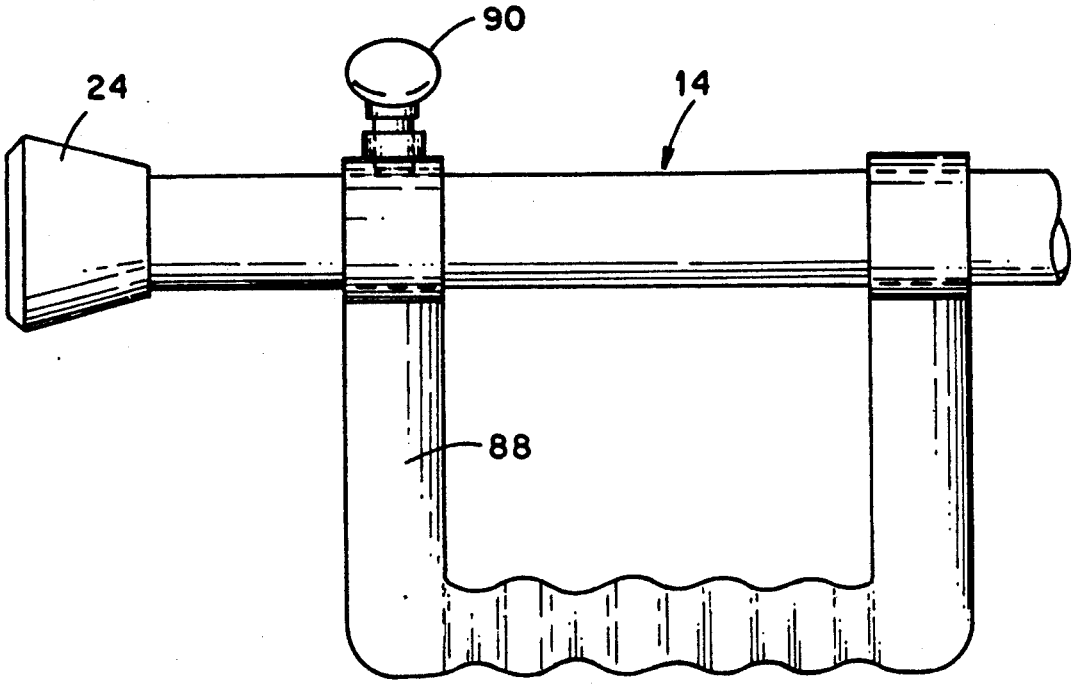
FIG. 8 is a still further embodiment of the present invention illustrating longitudinally movable hand grips on the tubular sections.

With the present invention utilized in either the rigid or flexible mode, considerable advantage may be realized by providing each end section 14 and 16 with a movable U-shaped handle 88 for gripping by the hands as generally shown in FIG. 8. These U-shaped handles 88 are preferably provided with a pair of bores or passageways through the upper ends thereof for permitting the handles 88 to be slipped onto the tube sections 14 and 16 for movement along a selected length of the tube sections. The handles 88 may be readily positioned in any suitable location along the length of the tube sections 14 and 16 and then held in place by a suitable clamp such as a screw-type clamp shown generally at 90.

Figure 9:
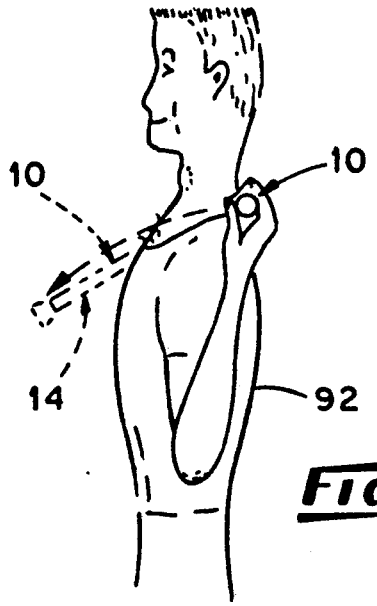
FIG. 9 is schematic view illustrating the aerobic wand of the present invention in a flexible mode as would be used in an aerobic exercise with the device placed behind the neck of an individual.

With the present invention in the flexible mode by using the rubber cylinder 62 or the spring 18, the wand 10 may be used in a aerobic exercise by placing the central section 12 behind the neck of a person as generally shown at 92 in FIG. 9 and then repeatedly moving the ends of the tube sections 14 and 16 forwardly against the bias of the spring 18 or cylinder 62 to exercise the shoulder and arm muscles to provide muscle tone and increase muscle mass in the arms and the shoulder area. Of course this same position of the wand may be used with the wand 10 in the rigid mode for providing for muscle conditioning or stretching.

It will be seen that the present invention provides an aerobic exercise device capable of providing multiple use functions either in a rigid or flexible mode whereby aerobic exercises suitable for muscle toning, conditioning, and exercising is achievable in a manner not heretofore available.

What is claimed is:

1. An aerobic device comprising:

a pair of elongated tubular means oriented in a longitudinally spaced apart end-to-end relationship in a longitudinal plane;

spring means positioned between and affixed to adjacently disposed end portions of each of the elongated tubular means for providing a biased flexural pivot point for each of the tubular means disposed on opposite sides of the spring means; and selectively movable means supported by the elongated tubular means for contacting said spring means to inhibit the pivoting of the tubular means about the flexural pivot point.

2. The aerobic device claimed in claim 1, wherein displaceable detent means are carried by one of said tubular means for engaging said movable means to maintain the latter in or out of contact with said spring means upon selective movement of the movable means.

3. The aerobic device claimed in claim 2, wherein said spring means is of an elongated cylindrical configuration, wherein the selectively movable means comprises an elongated rod means supported within the elongated tubular means, and wherein the elongated rod means is of a horizontal length sufficient to extend through said spring means into said end portions of each tubular means adjacent to said spring means when said rod means is in contact with said spring means.

4. The aerobic device claimed in claim 3, wherein said one tubular means is of a sufficient length to receive therein the elongated rod means when the latter is selectively moved out of contact with said means.

5. The aerobic device claimed in claim 4, wherein said detent means carried by said one tubular means is at a location adjacent to said spring means, wherein said detent means are contactable with one end of the elongated rod means when the latter is selectively moved into contact with said spring means and with an opposite end of the rod means when the latter is selectively moved into said one tubular means and out of contact with said spring means.

6. The aerobic device claimed in claim 5, wherein stop means are carried by said one tubular means for engaging said one end of the rod means when the latter is moved into said one tubular means, and wherein said stop means are sufficiently longitudinally spaced from said detent means for retaining said rod means therebetween.

7. The aerobic device claimed in claim 6, wherein further stop means are carried by the other of said pair of elongated tubular means for engaging said opposite end of the rod means when the rod means is moved into contact with said spring means, and wherein the further stop means are spaced a sufficient longitudinal distance from the detent means to retain the rod means therebetween and in contact with said spring means with end segments of said rod means extending into each said end portion of each tubular means to inhibit the pivoting of the tubular means.

8. The aerobic device claimed in claim 3, wherein said spring means comprises an elongated tension spring defined by a plurality of longitudinally spaced apart coils of essentially uniform diameter, and wherein each of said end portion of the tubular means is affixed to said spring for supporting the spring there between.

9. The aerobic device as claimed in claim 8, wherein said end portions of the tubular means are affixed to said spring by threaded means.

10. The aerobic device as claimed in claim 8, wherein tubular pad means are disposed about said tension spring and are at least coextensive therewith.

11. The aerobic device as claimed in claim 10, wherein said tubular pad means comprises and elastic sponge body of a cylindrical configuration.

12. The aerobic device as claimed in claim 11, wherein said sponge body is encased within an elastic sleeve.

13. The aerobic device claimed in claim 7, wherein said spring means comprises an elongated tension spring defined by a plurality of longitudinally spaced apart coils of essentially a uniform diameter, and wherein each said end portion of the tubular means is affixed to said spring for supporting the spring there between.

14. The aerobic device as claimed in claim 13, wherein said end portions of the tubular means are affixed to said spring by threaded means.

15. The aerobic device as claimed in claim 13, wherein tubular pad means are disposed about said tension spring and are at least coextensive therewith.

16. The aerobic device as claimed in claim 15, wherein said tubular pad means comprises an elastic sponge body of a cylindrical configuration.

17. The aerobic device as claimed in claim 16, wherein said sponge body is encased within an elastic sleeve.

18. The aerobic device as claimed in claim 17,. wherein pad means are disposed on each of said elongated tubular means at an end thereof longitudinally spaced from said spring means.

19. The aerobic device as claimed in claim 3, wherein a generally u-shaped handle means is supported on each of said pair of tubular means at a location longitudinally spaced from said spring means, and wherein means movably attach each of said handle means to each of said tubular means for positioning the handle means at a selected longitudinal position on each tubular means.

20. The aerobic device as claimed in claim 5, wherein said one tubular means is provided with an opening through a wall thereof, wherein said detent means comprises an elongated spring having opposite end segments with one end segment of the elongated spring attached to said one of the tubular means on an outer surface thereof at a location adjacent to said opening and with the other end segment of the elongated spring disposed at an angle to said one end segment of the elongated spring and extending through said opening for contacting said elongated rod means.

21. The aerobic device as claimed in claim 3, wherein said spring means comprises an elongated cylinder, of flexible material.

22. The aerobic device as claimed in claim 2, wherein the longitudinal length of said pair of elongated tubular means with the spring means positioned therebetween is in the range of about 36 to 72 inches.

23. The aerobic device as claimed in claim 2, wherein said spring means is of an elongated cylindrical configuration, wherein each adjacently disposed end portion of each elongated tubular means is disposed about and affixed to an end section of spring means, wherein the selectively movable means comprises tube means disposed about the tubular means and displaceable over said end portions of the elongated tubular means and said spring means.

24. The aerobic device as claimed in claim 23, wherein tubular pad means are disposed about said spring means intermediate said end portions of the tubular means.

* * * * *